US012378716B2

(12) United States Patent
Bodine et al.

(10) Patent No.: US 12,378,716 B2
(45) Date of Patent: Aug. 5, 2025

(54) LAUNDRY APPLIANCE

(71) Applicant: WHIRLPOOL CORPORATION, Benton Harbor, MI (US)

(72) Inventors: Darryl C. Bodine, St. Joseph, MI (US); Michael Adam Ledford, St. Joseph, MI (US); Sayer James Murphy, St. Joseph, MI (US); Anna C. Schelling, Stevensville, MI (US); Meagan Kathleen VanderVelde, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1020 days.

(21) Appl. No.: 17/342,656

(22) Filed: Jun. 9, 2021

(65) Prior Publication Data

US 2022/0396910 A1 Dec. 15, 2022

(51) Int. Cl.
*D06F 58/22* (2006.01)
*D06F 58/02* (2006.01)

(52) U.S. Cl.
CPC ..... *D06F 58/22* (2013.01); *D06F 58/02* (2013.01)

(58) Field of Classification Search
None
See application file for complete search history.

(56) References Cited

U.S. PATENT DOCUMENTS

| | | | |
|---|---|---|---|
| 2009/0136626 | A1 | 5/2009 | Mueller |
| 2019/0143154 | A1 | 5/2019 | Gangadhar et al. |
| 2019/0351459 | A1 | 11/2019 | Dal Molin et al. |
| 2020/0340170 | A1 | 10/2020 | MacDonald, III et al. |

FOREIGN PATENT DOCUMENTS

| | | | | | |
|---|---|---|---|---|---|
| CN | 102666966 | A | * | 9/2012 | ..... D06F 58/206 |
| CN | 110409154 | A | | 11/2019 | |
| CN | 211772213 | U | | 10/2020 | |
| DE | 102015110215 | A1 | | 12/2016 | |
| EP | 2273005 | A2 | | 1/2011 | |
| EP | 3090094 | | | 7/2015 | |
| EP | 3234255 | | | 6/2016 | |
| EP | 3562987 | | | 7/2018 | |
| EP | 3562989 | | | 7/2018 | |
| EP | 3234255 | B1 | * | 5/2019 | ..... D06F 25/00 |
| WO | 2016034302 | A1 | | 3/2016 | |

* cited by examiner

*Primary Examiner* — Jason Lau
(74) *Attorney, Agent, or Firm* — Price Heneveld LLP

(57) ABSTRACT

A laundry appliance includes a cabinet having a front panel that defines an opening, a drum accessible via the opening and configured for processing laundry, an access panel pivotably coupled to the front panel and operable to pivot between first and second conditions, and a first lint filter pivotably coupled to the front panel and operable to pivot relative to the front panel between a use position and a maintenance position in the second condition of the access panel. The access panel covers the first lint filter in the first condition, and access to the first lint filter is provided in the second condition of the access panel.

7 Claims, 9 Drawing Sheets

LAUNDRY APPLIANCE

BACKGROUND OF THE DISCLOSURE

The present disclosure generally relates to a laundry appliance and, more specifically, to a laundry appliance that includes a lint filter.

SUMMARY OF THE DISCLOSURE

According to one aspect of the present disclosure, a laundry appliance includes a cabinet having a front panel that defines an opening, a drum accessible via the opening and configured for processing laundry, an access panel pivotably coupled to the front panel and operable to pivot between first and second conditions, and a first lint filter pivotably coupled to the front panel and operable to pivot relative to the front panel between a use position and a maintenance position in the second condition of the access panel. The access panel covers the first lint filter in the first condition, and access to the first lint filter is provided in the second condition of the access panel.

According to another aspect of the present disclosure, a laundry appliance includes a cabinet having a front panel. The laundry appliance also includes an access panel removably coupled to the front panel and operable between a first condition and a second condition. In the first condition, the access panel is attached to the front panel. In the second condition, the access panel is detached from the front panel. The laundry appliance also includes a first lint filter coupled to the access panel and operable between use and maintenance positions. The first lint filter is in the use position in the first condition of the access panel, and the first lint filter is in the maintenance position in the second condition of the access panel. The laundry appliance further includes a second lint filter positioned proximate to the front panel. Movement of the access panel from the first condition to the second condition provides access to the second lint filter.

According to yet another aspect of the present disclosure, a laundry appliance includes a cabinet having a front panel that defines an opening, and a drum accessible via the opening and operable to rotate about an axis of rotation that is downward of a midpoint of the opening.

These and other features, advantages, and objects of the present disclosure will be further understood and appreciated by those skilled in the art by reference to the following specification, claims, and appended drawings.

Figure 1:
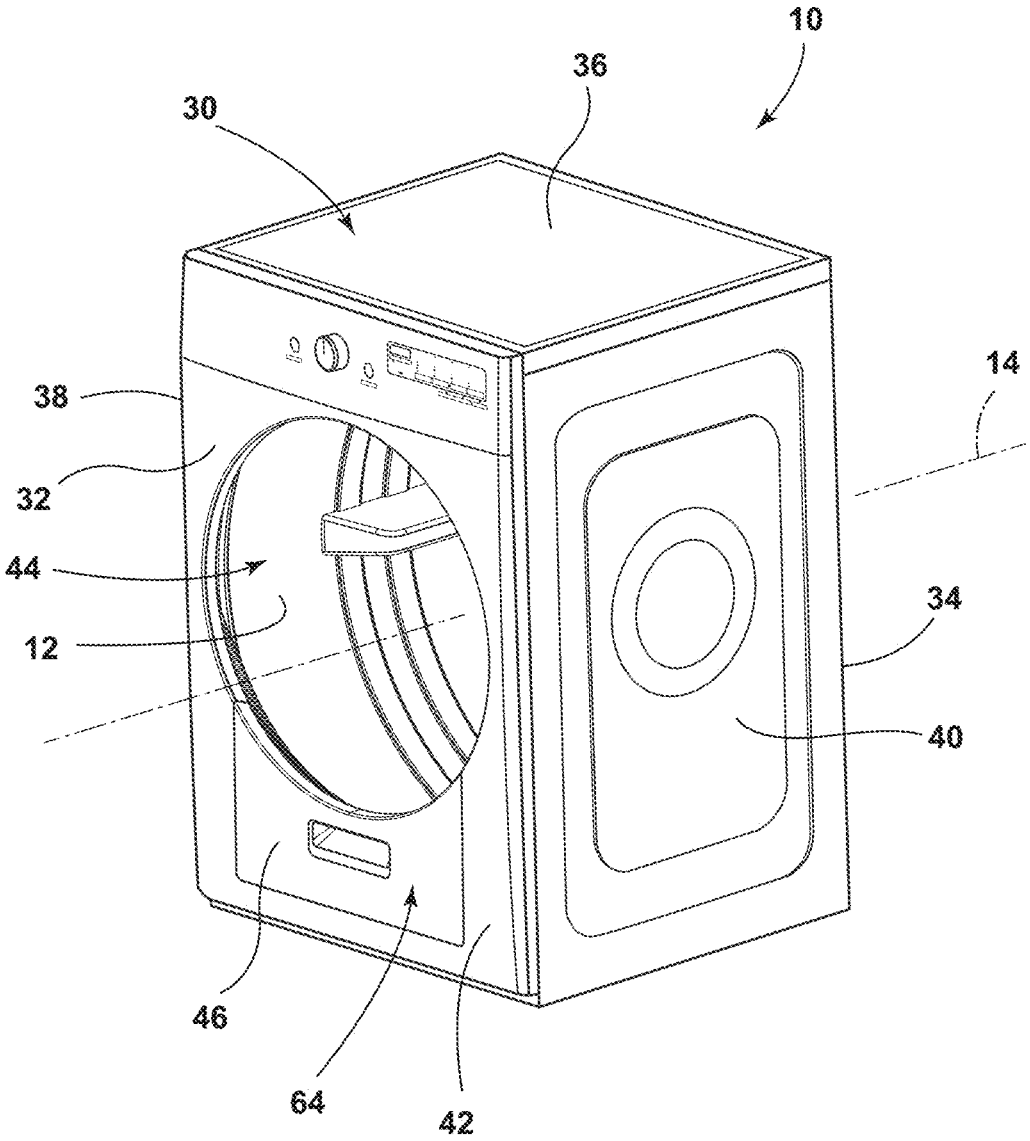
FIG. 1 is a top perspective view of a laundry appliance that includes an access panel.

The components in the figures are not necessarily to scale, emphasis instead being placed upon illustrating the principles described herein.

DETAILED DESCRIPTION

The present illustrated embodiments reside primarily in combinations of apparatus components related to a laundry appliance. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

Figure 2:
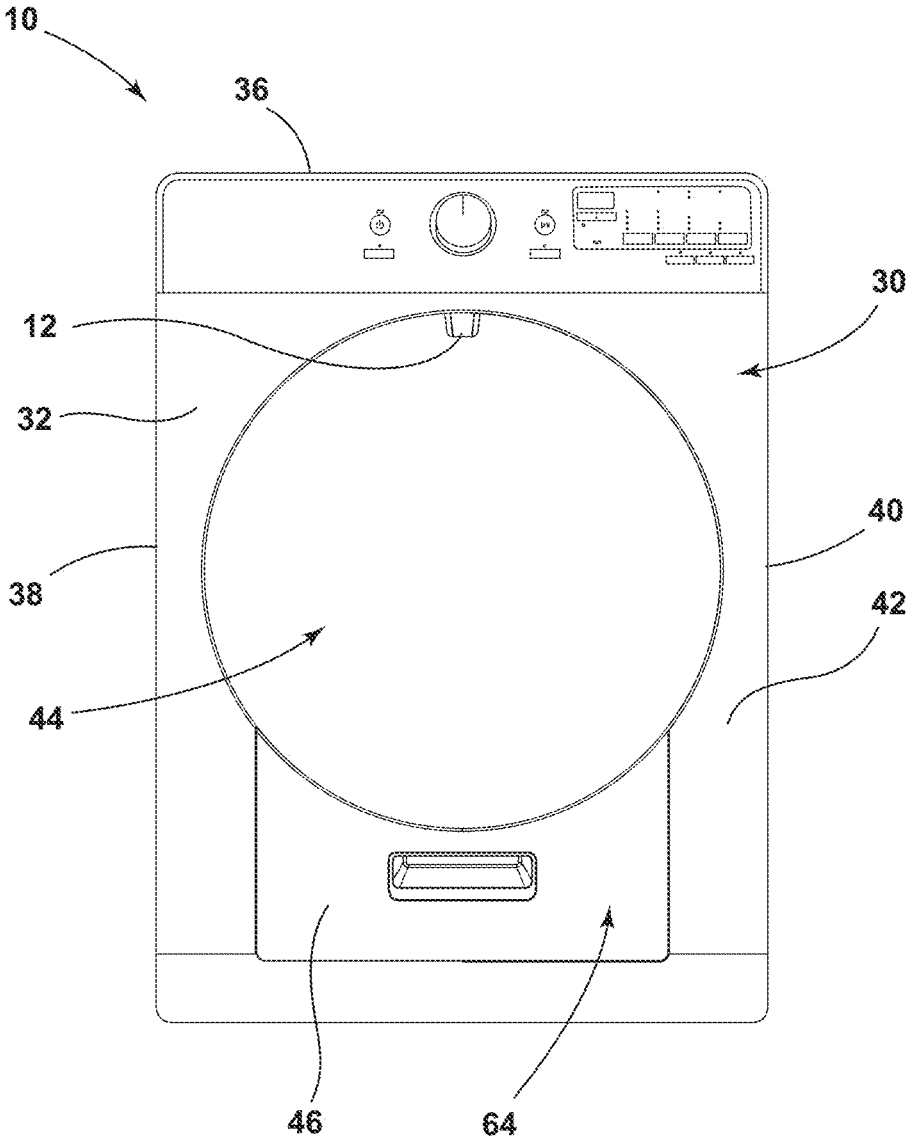
FIG. 2 is a front elevational view of a laundry appliance that includes an access panel.

For purposes of description herein, the terms "upper," "lower," "right," "left," "rear," "front," "vertical," "horizontal," and derivatives thereof shall relate to the disclosure as oriented in FIG. 2. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, article, or apparatus that comprises a list of elements does not necessarily include only those elements but may include other elements not expressly listed or inherent to such process, article, or apparatus. An element proceeded by "comprises a . . . " does not, without more constraints, preclude the existence of additional identical elements in the process, article, or apparatus that comprises the element.

With respect to FIGS. 1-10, reference numeral 10 generally designates a laundry appliance. The laundry appliance 10 can include various mechanisms for washing, drying, or otherwise processing laundry. Typically, the laundry appliance 10 includes a drum 12 that is configured to rotate about an axis of rotation 14 for processing laundry. A blower 16 is disposed within the laundry appliance 10 and delivers process air 18 through an airflow path 20 of the laundry appliance 10. The blower 16 can be a fan, an air handling unit, or other air moving device that can move process air 18 through the drum 12 using positive pressure or negative pressure via an induced flow of process air 18 through the drum 12. The airflow path 20 can include various air-conditioning mechanisms 22. These air-conditioning mechanisms 22 can include one or more heat exchangers, electrical heaters, and other similar mechanisms that serve to heat and, in certain applications, cool the process air 18 within the laundry appliance 10. At least a first lint filter 24 is positioned within the airflow path 20 and is configured to filter particulate matter 28, such as lint particles, from the process air 18. In the embodiment illustrated in FIG. 10, process air 18 entering the airflow path 20 initially is drawn past the air-conditioning mechanism 22 that heats the process air 18. Next, the process air 18 is delivered to the drum 12. A combination of particulate matter 28 from within the drum 12 and the process air 18 flows out of the drum 12 and through the first lint filter 24. The first lint filter 24 filters at least some of the particulate matter 28 from the process air 18. Next, the process air 18 and any remaining particulate matter 28 within the process air 18 is delivered to a second lint filter 26. The second lint filter 26 further filters the particulate matter 28 from the process air 18. Finally, the process air 18 is expelled from the laundry appliance 10 by the blower 16.

Figure 3:
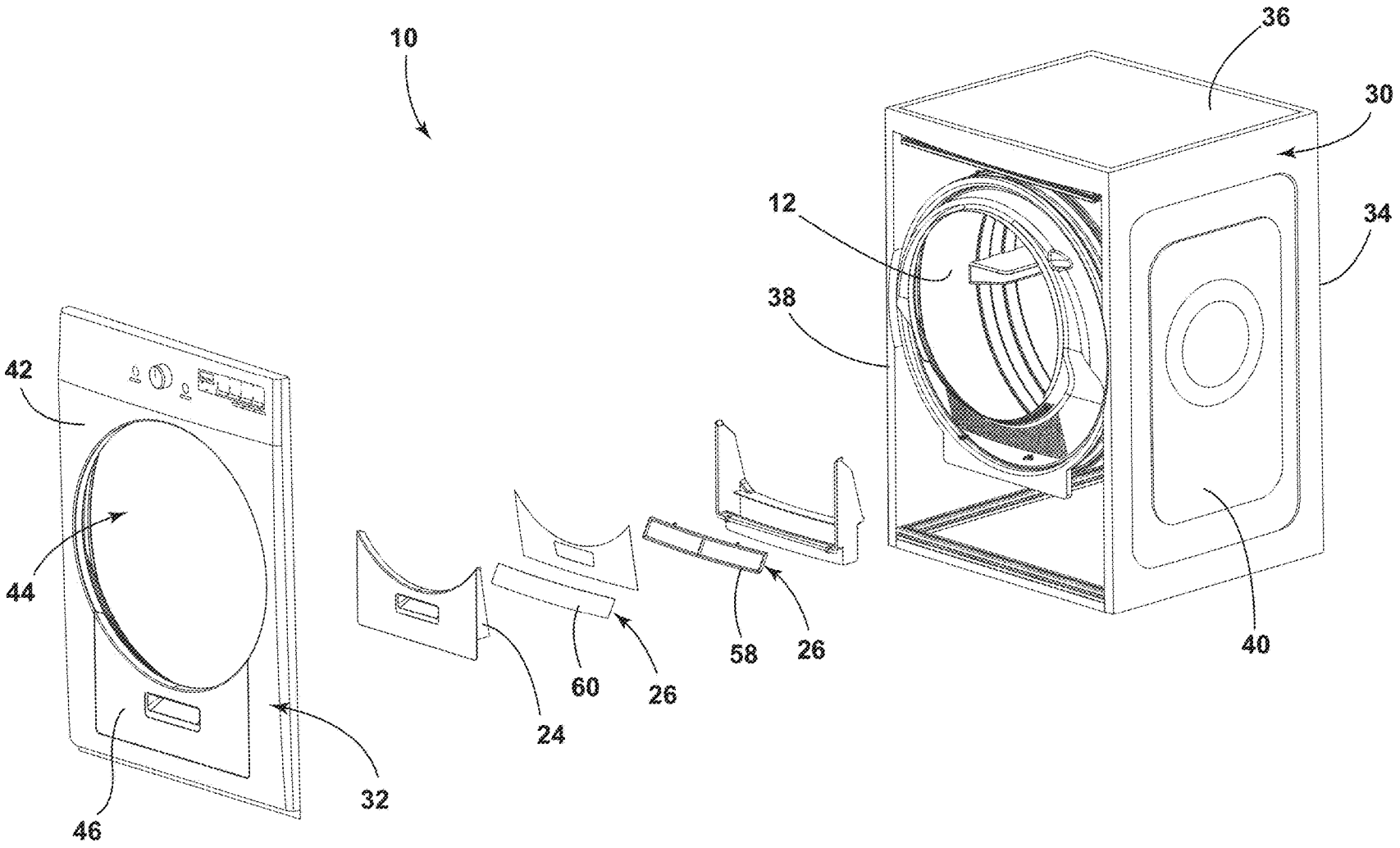
FIG. 3 is an exploded view of a laundry appliance that illustrates a first lint filter and a second lint filter.

Referring now to FIGS. 1-3, the laundry appliance 10 includes a cabinet 30. The cabinet 30 includes a front side 32 and a rear side 34 that is opposite the front side 32. A top side 36 extends between the front and rear sides 32, 34. Left and right sides 38, 40 extend downward from the top side 36 in between the front and rear sides 32, 34. In various embodiments, the cabinet 30 of the laundry appliance 10 houses a variety of laundry appliance components. For example, as illustrated in FIG. 1, the drum 12 of the laundry appliance 10 is housed within the cabinet 30. The cabinet 30 may include a front panel 42 that forms at least a portion of the front side 32 of the cabinet 30. It is contemplated that the front panel 42 may be an assembly of a plurality of components at the front side 32 of the cabinet 30, in some implementations. The front panel 42 defines an opening 44, as illustrated in FIGS. 1-3. The drum 12 housed within the cabinet 30 is accessible via the opening 44 defined by the front panel 42. In the embodiments illustrated in FIGS. 1-3, the opening 44 is substantially circular. A variety of shapes of opening 44 are contemplated. Although not shown, the laundry appliance 10 may include a door that is coupled to the cabinet 30 and operable to cover the opening 44 in a closed position and reveal the opening 44 in an open position. In some embodiments, the door covers the opening 44 by forming a seal with the front panel 42 and an access panel 46.

Figure 4:
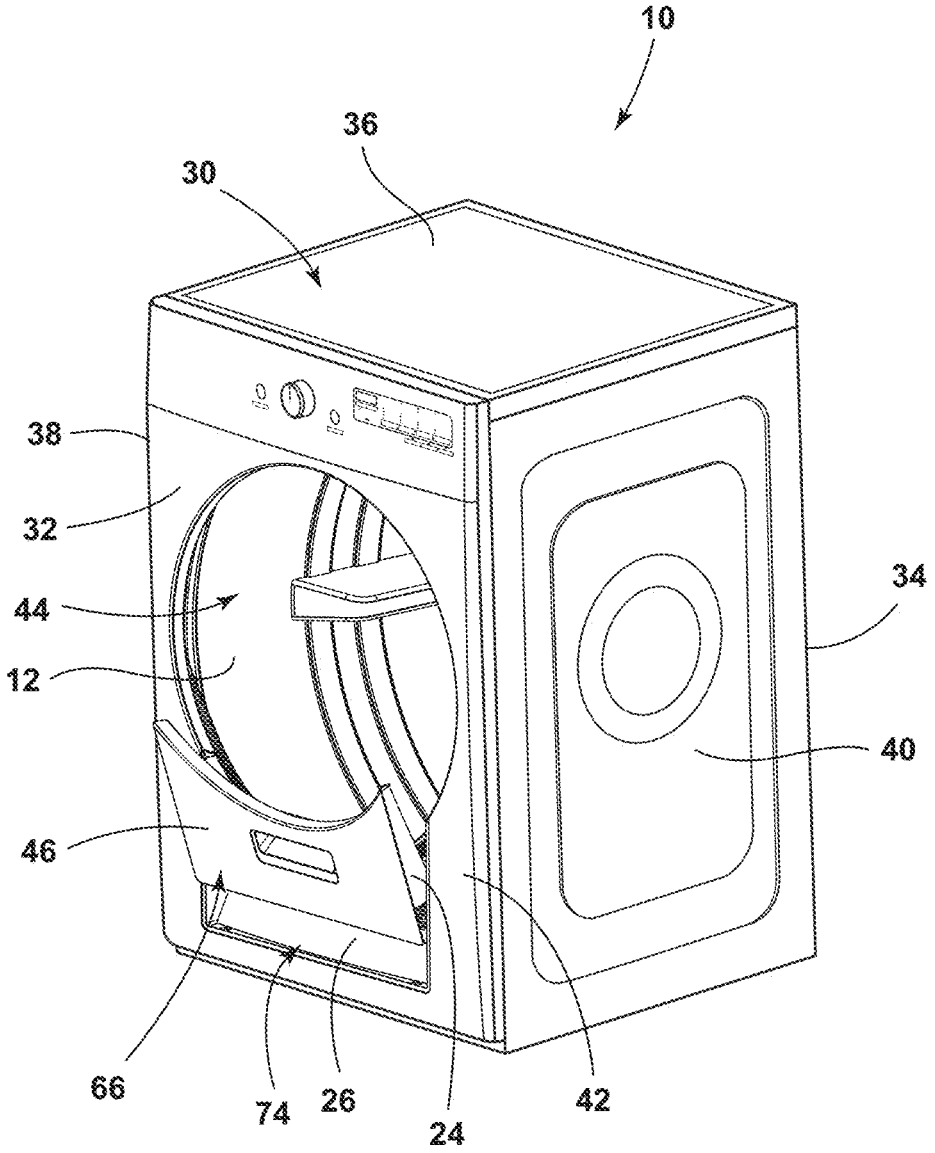
FIG. 4 is a top perspective view of a laundry appliance illustrating an access panel removed from the laundry appliance.
Figure 5:
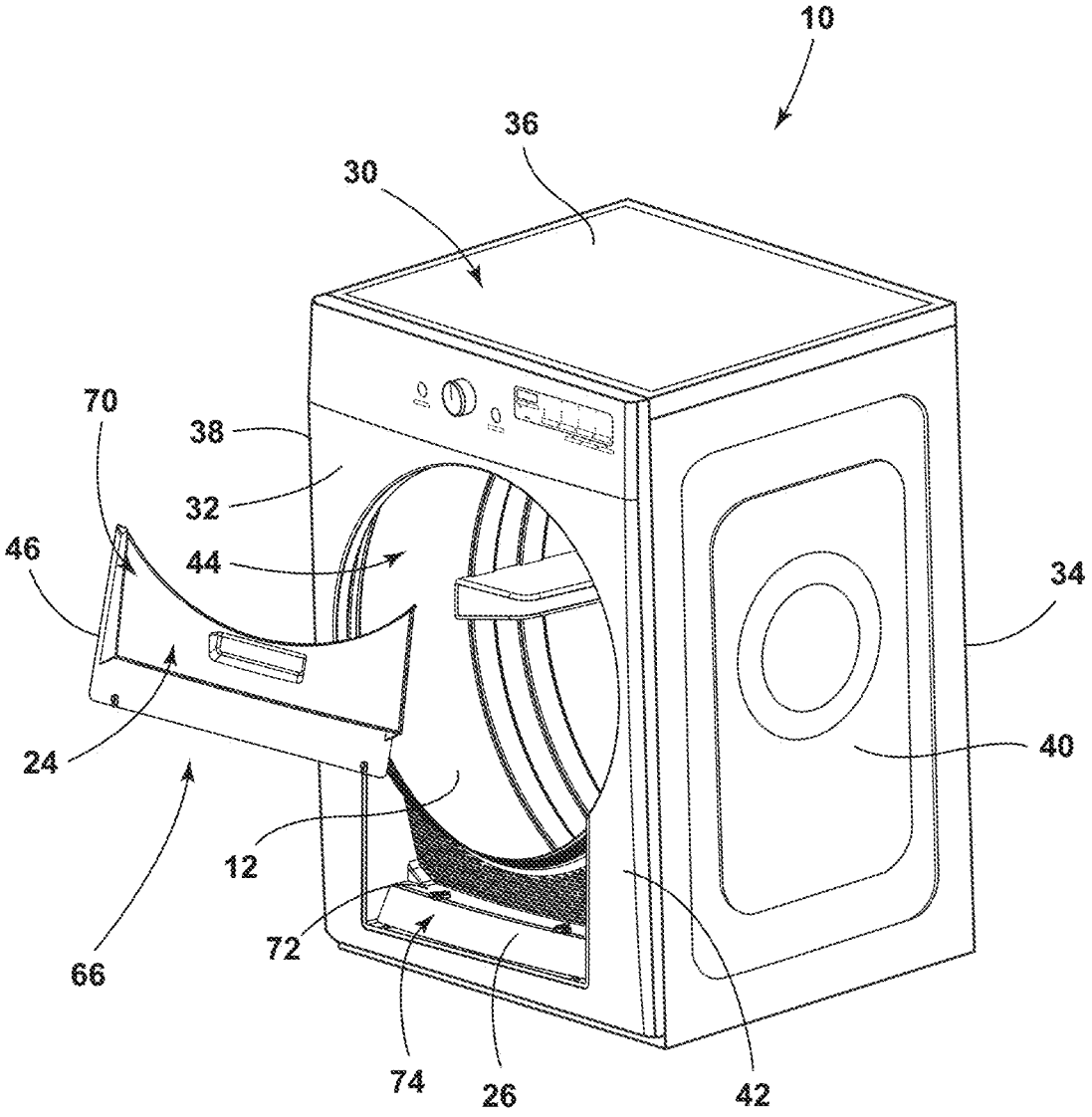
FIG. 5 is a top perspective view of a laundry appliance that illustrates an access panel removed from the laundry appliance, a first lint filter coupled to the access panel, and a second lint filter coupled to the laundry appliance.

Referring now to FIGS. 1-7, the laundry appliance 10 includes the access panel 46. The access panel 46 is positioned at the front side 32 of the cabinet 30. In various implementations, the access panel 46 is operably coupled to the front panel 42 of the cabinet 30. The access panel 46 is operable between a first condition 64 and a second condition 66. In some embodiments, the access panel 46 is configured to move from the first condition 64 to the second condition 66 via detachment of the access panel 46 from the front panel 42. For example, in the embodiment illustrated in FIGS. 1, 4, and 5, the access panel 46 is removably coupled to the front panel 42 of the cabinet 30 and is operable between the first condition 64, wherein the access panel 46 is attached to the front panel 42 (FIG. 1), and the second condition 66, wherein the access panel 46 is detached from the front panel 42 (FIGS. 4 and 5).

Figure 6:
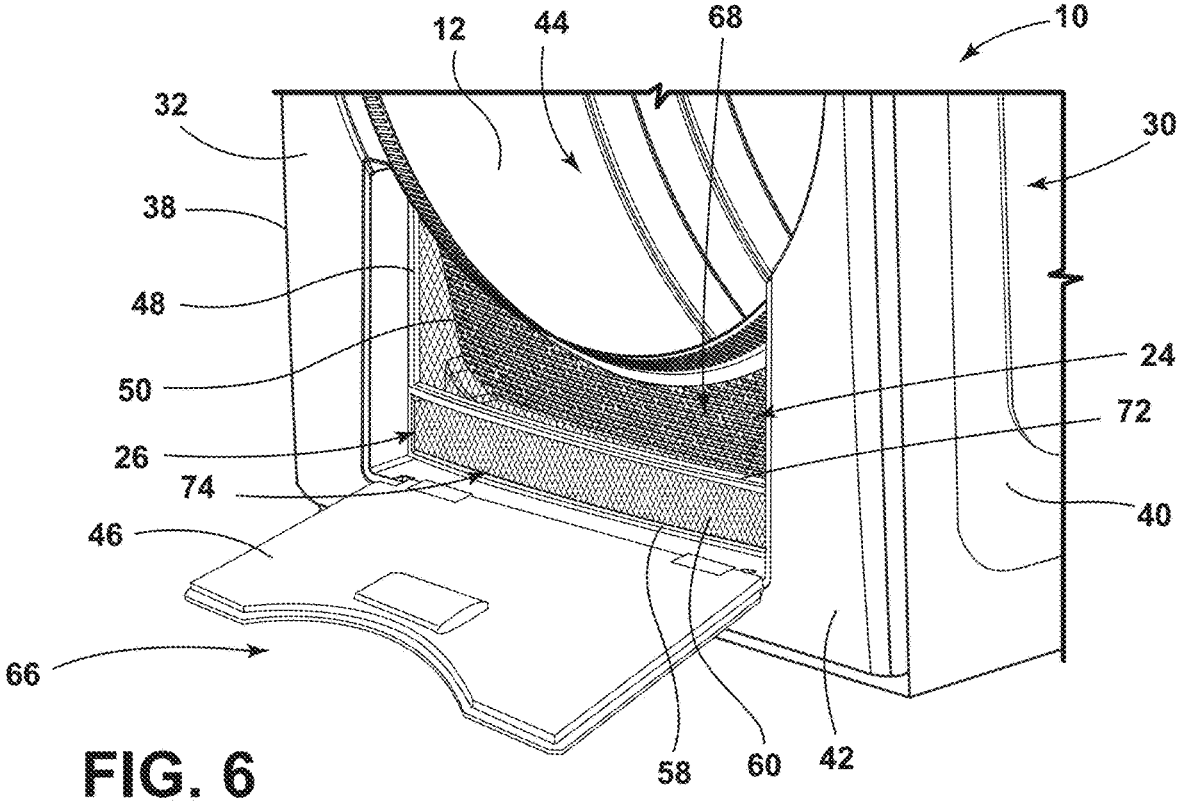
FIG. 6 is a partial view of a laundry appliance that illustrates an access panel pivoted open to reveal first and second lint filters.
Figure 7:
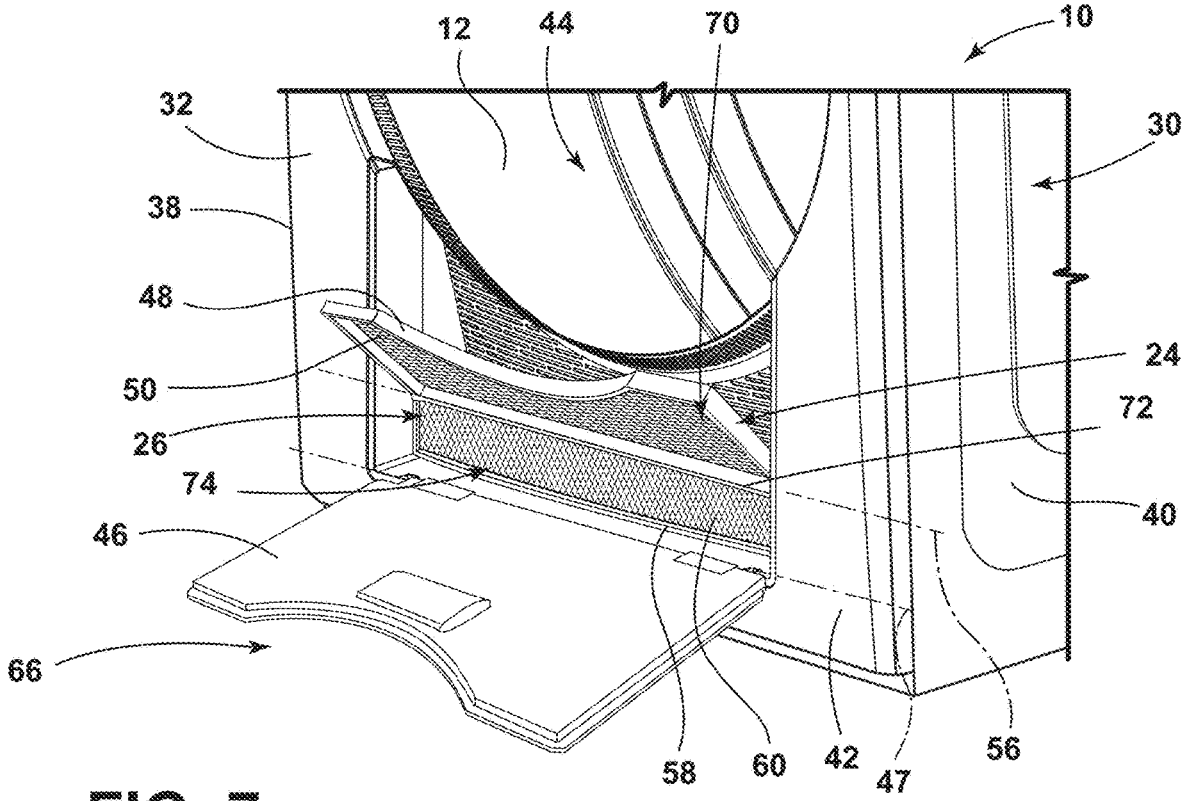
FIG. 7 is a partial view of a laundry appliance that illustrates an access panel pivoted open to reveal a first lint filter pivoted to a maintenance position and a second lint filter.

In some embodiments, the access panel 46 is operable to pivot between the first and second conditions 64, 66. For example, as illustrated in FIGS. 2, 6, and 7, the access panel 46 is pivotably coupled to the front panel 42 and operable to pivot relative to the front panel 42 from the first condition 64, as illustrated in FIG. 2, to the second condition 66, as illustrated in FIGS. 6 and 7. In the illustrated embodiment, the access panel 46 pivots downward and away from the drum 12 about a generally horizontal access panel-pivot axis 47 that extends generally laterally and generally parallel with the front panel 42, as the access panel 46 moves from the first condition 64 to the second condition 66.

Referring still to FIGS. 1-7, the access panel 46 and the front panel 42 of the cabinet 30 may cooperate to define the opening 44 in the first condition 64 of the access panel 46. For example, as illustrated in FIGS. 1 and 2, wherein the access panel 46 is in the first condition 64, the access panel 46 defines the lowermost portion of the circular opening 44, while the front panel 42 defines the remainder of the opening 44 that is upward of the access panel 46. As described further herein, the access panel 46 may cover the first lint filter 24 and/or the second lint filter 26 in the first condition 64, and access to the first lint filter 24 and/or the second lint filter 26 may be provided in the second condition 66 of the access panel 46.

Figure 8:
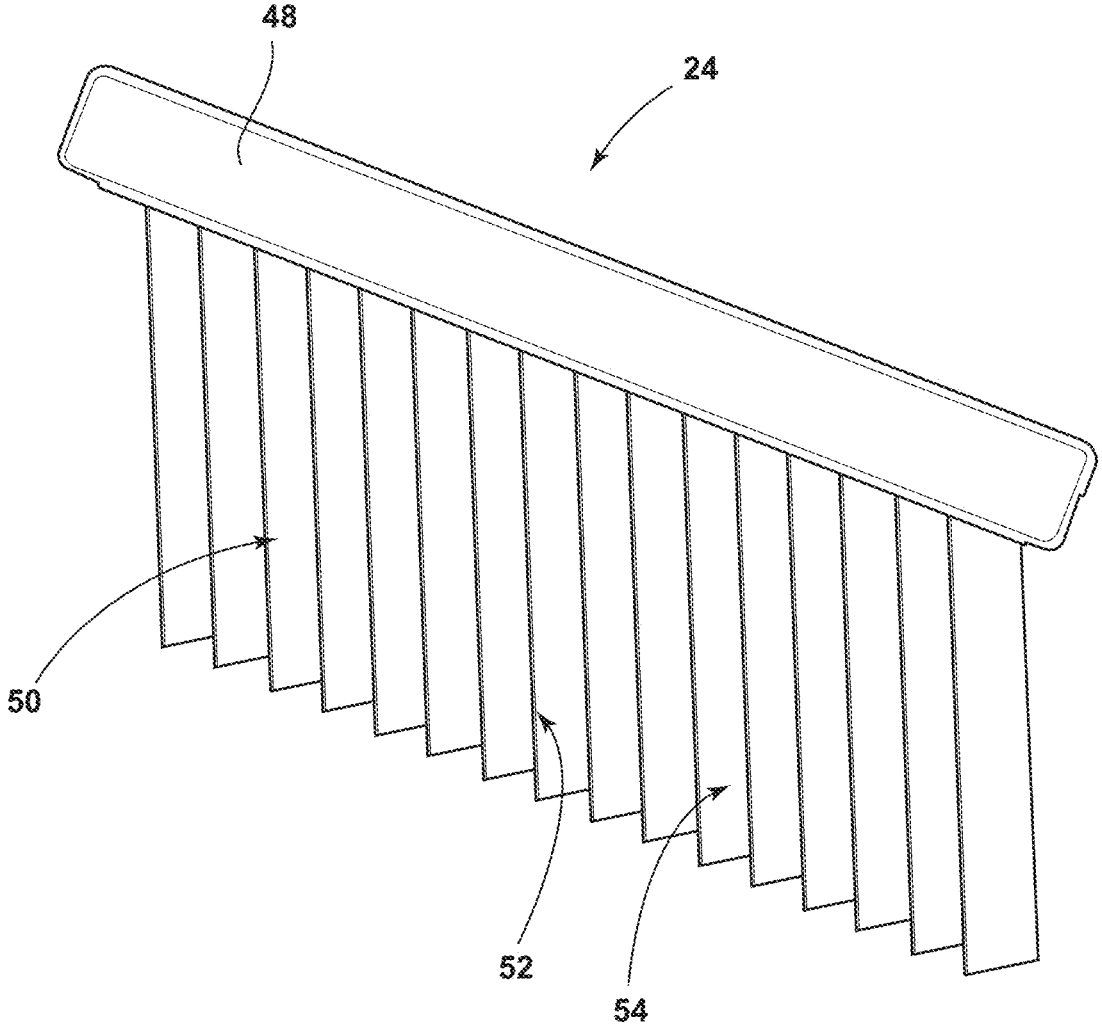
FIG. 8 is a top perspective view of a lint filter that includes alternate ridges and grooves.

Referring now to FIGS. 1-8, the laundry appliance 10 includes the first lint filter 24. The first lint filter 24 may be positioned proximate to the front side 32 of the cabinet 30. In various implementations, the first lint filter 24 is positioned downward of the opening 44 defined by the front panel 42. The first lint filter 24 may include a first lint filter frame 48 and a first lint filter screen 50 coupled to the first lint filter frame 48. In various embodiments, the first lint filter screen 50 extends across the first lint filter frame 48. In operation of the laundry appliance 10, the first lint filter screen 50 is configured to filter particulate matter 28 from the process air 18, as the process air 18 flows through the first lint filter screen 50. In some embodiments, the first lint filter screen 50 is corrugated. In other words, the first lint filter screen 50 is shaped to form alternate ridges 52 and grooves 54. For example, as illustrated in FIG. 8, the first lint filter screen 50 is coupled to the first lint filter frame 48 and is shaped to form a plurality of ridges 52 and a plurality of grooves 54 that are positioned between the plurality of ridges 52.

In some implementations, the first lint filter 24 is operable between a use position 68 and a maintenance position 70. In the use position 68, the first lint filter 24 is positioned within the airflow path 20, such that particulate matter 28 is filtered from the process air 18 that is delivered through the first lint filter 24. In the maintenance position 70, the first lint filter 24 is positioned such that particulate matter 28 is accessible for removal from the first lint filter 24 by a user. In some implementations, the first lint filter 24 is operable to pivot between the use position 68 and the maintenance position 70. For example, as illustrated in FIGS. 6 and 7, the first lint filter 24 is pivotably coupled to the front panel 42 and operable to pivot relative to the front panel 42 between the use position 68, as illustrated in FIG. 6, and the maintenance position 70, as illustrated in FIG. 7. In the illustrated embodiment, the first lint filter 24 pivots downward and away from the drum 12 about a generally horizontal pivot axis 56 that extends generally laterally, as the first lint filter 24 moves from the use position 68 to the maintenance position 70. The pivot axis 56 and the access panel-pivot axis 47 may be generally parallel to each other, as illustrated in FIG. 7.

Referring now to FIGS. 1, 4, and 5, in some implementations, the first lint filter 24 is coupled to the access panel 46, such that the movement of the access panel 46 from the first condition 64 to the second condition 66 moves the first lint filter 24 from the use position 68 to the maintenance position 70. For example, as illustrated in FIGS. 1, 4, and 5, the first lint filter 24 is fixedly mounted to the access panel 46 and disposed on a side of the access panel 46 that faces toward the rear side 34 of the cabinet 30 in the first condition 64 of the access panel 46. As such, movement of the access panel 46 from the first condition 64, wherein the access panel 46 is attached to the front panel 42, as illustrated in FIG. 1, to the second condition 66, wherein the access panel 46 is detached from the front panel 42, as illustrated in FIGS. 4 and 5, causes the first lint filter 24 to move from the use position 68, which corresponds with the first condition 64 of the access panel 46, to the maintenance position 70, which corresponds with the second condition 66. It is contemplated that the first lint filter 24 may transition between the use and maintenance positions 68, 70 in at least one of a variety of manners in various implementations. Further, in some examples, movement of the access panel 46 to the second condition 66 allows and/or causes movement of the first lint filter 24 from the use position 68 to the maintenance position 70.

Referring now to FIGS. 3-7, the laundry appliance 10 includes the second lint filter 26. The second lint filter 26 may be positioned proximate to the first lint filter 24. In some examples, the second lint filter 26 is positioned downward of the first lint filter 24. As illustrated in FIGS. 5-7, a divider 72 is positioned between the first and second lint filters 24, 26. In the embodiment illustrated in FIG. 6, the divider 72 is positioned vertically between the first and second lint filters 24, 26. In various implementations, the divider 72 is configured to aid in creating a generally sealed airflow path 20 together with the access panel 46 while the access panel 46 is in the first condition 64. The second lint filter 26 may include a second lint filter frame 58 and a second lint filter screen 60 that is coupled to the second lint filter frame 58. The second lint filter screen 60 extends across the second lint filter frame 58, as illustrated in FIGS. 6 and 7.

Referring now to FIGS. 1, 2, 5, and 6, the access panel 46 typically covers the second lint filter 26 in the first condition 64, and access to the second lint filter 26 can be provided in the second condition 66 of the access panel 46. For example, in the embodiment illustrated in FIGS. 1 and 5, the access panel 46 covers the second lint filter 26 in the first condition 64, as illustrated in FIG. 1, and access is provided to the second lint filter 26 in the second condition 66 of the access panel 46, as illustrated in FIG. 5. Further, in the embodiment illustrated in FIGS. 2 and 6, the access panel 46 covers the second lint filter 26 in the first condition 64, as illustrated in FIG. 2, and access is provided to the second lint filter 26 in the second condition 66 of the access panel 46, wherein the access panel 46 is pivoted open as illustrated in FIG. 6.

Referring again to FIG. 6, the first lint filter screen 50 and the second lint filter screen 60 may be generally coplanar in the use position 68 of the first lint filter 24. As illustrated in FIG. 6, the first lint filter screen 50 extends across the first lint filter frame 48 vertically and laterally in the use position 68 of the first lint filter 24. As such, the first lint filter screen 50 generally forms a plane that is parallel to a plane of the front side 32 of the cabinet 30. As further illustrated in FIG. 6, the second lint filter screen 60 is positioned below the first lint filter 24 and extends across the second lint filter frame 58 vertically and laterally, such that the second lint filter screen 60 is generally coplanar with the first lint filter screen 50 in the use position 68 of the first lint filter screen 50.

In some implementations, the second lint filter 26 is configured to be removed from and returned to an operating position 74. In the operating position 74 (exemplified in FIG. 5), the second lint filter 26 is configured to filter particulate matter 28 from the process air 18 delivered by the blower 16 of the laundry appliance 10. Removal of the second lint filter 26 from the operating position 74 enables thorough cleaning of the second lint filter 26 and/or may provide access to various components of the laundry appliance 10 for servicing.

Figure 10:
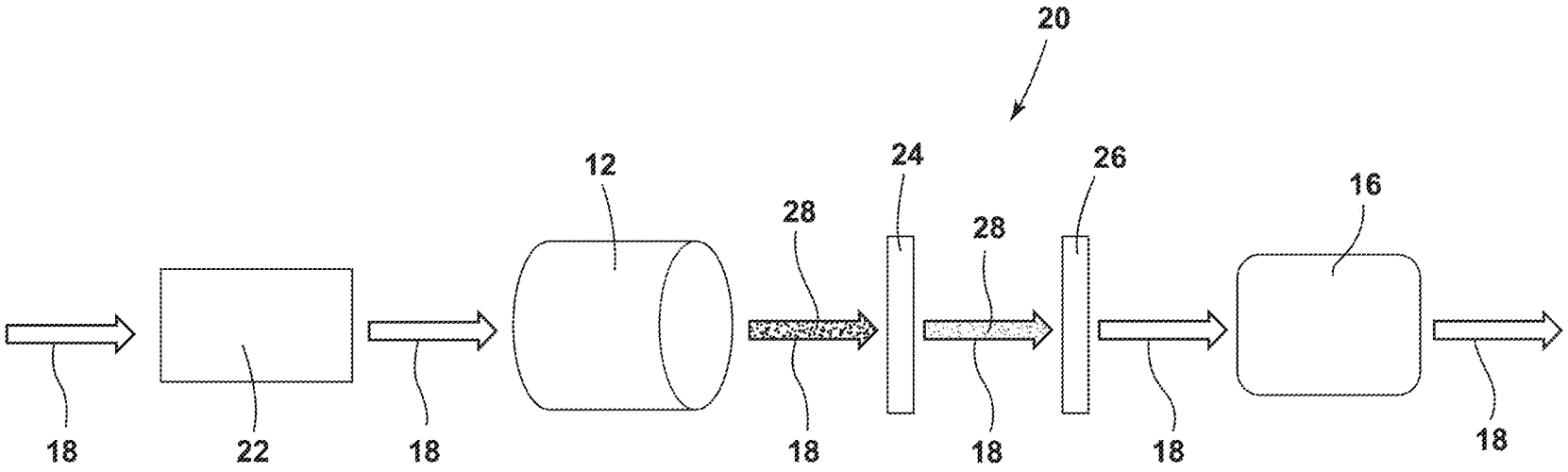
FIG. 10 is a schematic diagram of an airflow path for a laundry appliance including first and second lint filters.

Referring now to FIGS. 6 and 10, the blower 16 delivers process air 18 through the airflow path 20 such that the process air 18 flows from the drum 12 to the first lint filter 24 and subsequently to the second lint filter 26. In some implementations, the process air 18 flows through the first lint filter 24 toward the access panel 46 and through the second lint filter 26 away from the access panel 46. For example, in the embodiment illustrated in FIG. 6, process air 18 flows out of the drum 12 toward the front side 32 of the cabinet 30. The process air 18 flows through the first lint filter 24 toward the access panel 46 that is positioned forward of the first lint filter 24 such that the first lint filter 24 is positioned between the drum 12 and the access panel 46. Next, the process air 18 flows through the second lint filter 26 generally toward the rear side 34 of the cabinet 30 and away from the access panel 46. Although the access panel 46 is illustrated in the open, second condition 66 to demonstrate the flow of process air 18 through the first and second lint filters 24, 26 in FIG. 6, in operation of the laundry appliance 10, the access panel 46 is typically in the closed, first condition 64, as illustrated in FIG. 2, such that the process air 18 flowing through the first lint filter 24 toward the access panel 46 is directed, in part, by the access panel 46 to the second lint filter 26. In various implementations, the access panel 46 and the divider 72 cooperate to form a chamber that is generally sealed, such that the process air 18 is contained within the airflow path 20.

In various embodiments, particulate matter 28 accumulates on sides of the first and second lint filter screens 50, 60 that face in generally opposite directions relative to each other. For example, in the embodiment illustrated in FIG. 6, particulate matter 28 accumulates on a side of the first lint filter screen 50 that is facing toward the rear side 34 of the cabinet 30, and particulate matter 28 accumulates on a side of the second lint filter screen 60 that is facing the front side 32 of the cabinet 30.

Figure 9:
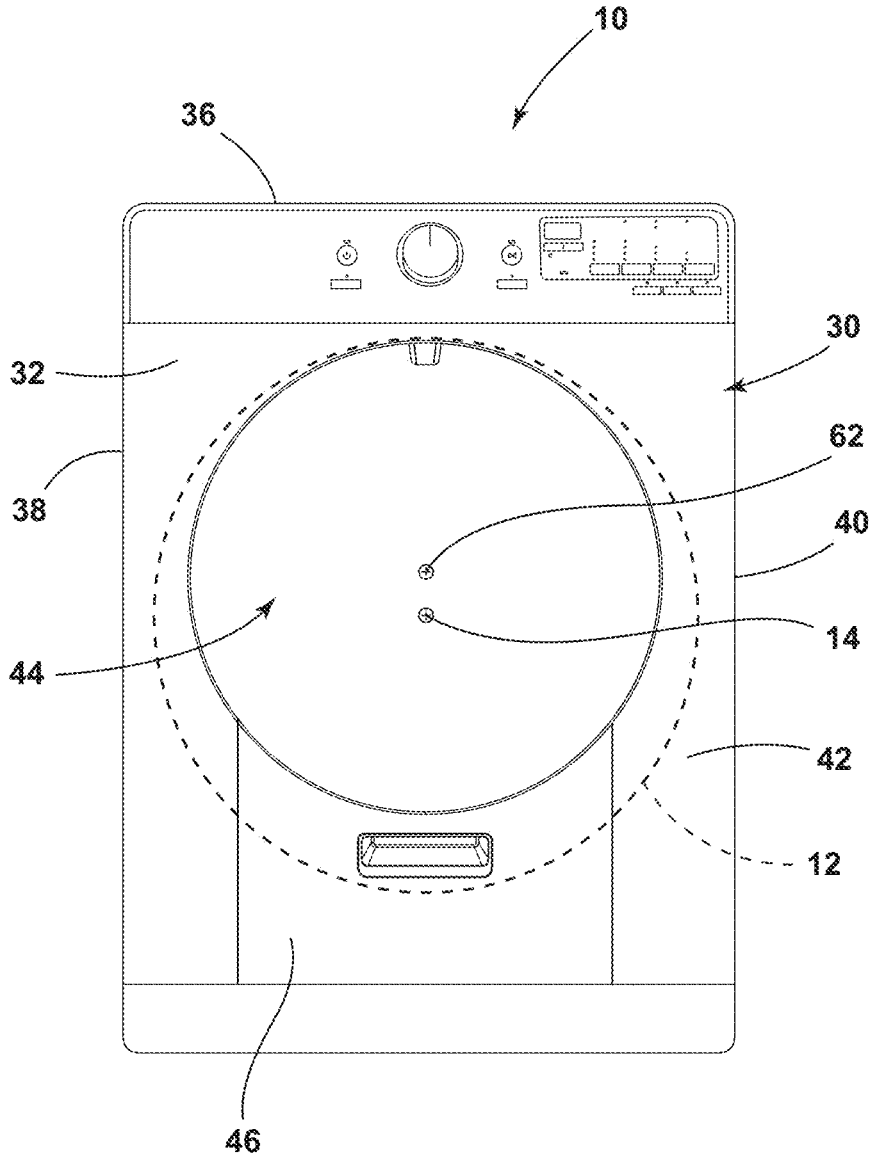
FIG. 9 is a front elevational view of a laundry appliance that illustrates a drum of the laundry appliance in phantom.

Referring now to FIG. 9, the opening 44 defined by the front panel 42 and/or the access panel 46 in the first condition 64 includes a midpoint 62. In some embodiments, the midpoint 62 is the vertical center between the top of the opening 44 and the bottom of the opening 44 while the access panel 46 is in the first condition 64. In some embodiments, wherein at least a portion of the opening 44 is circularly curved, the midpoint 62 is the radial center of the circularly curved portion. For example, in the embodiments illustrated in FIG. 9, the opening 44 is generally circular, and the midpoint 62 is the vertical and radial center of the opening 44. In some embodiments, the axis of rotation 14 that the drum 12 within the cabinet 30 is operable to rotate about is downward of the midpoint 62 of the opening 44. For example, as illustrated in FIG. 9, the axis of rotation 14 of the drum 12 is downward of the midpoint 62 of the generally circular opening 44. As such, the opening 44 is offset from the drum 12 in a vertically-upward direction. Offsetting the opening 44 in this way generally increases the space below the opening 44 within which the first and/or second lint filters 24, 26 reside.

In a first exemplary embodiment of the laundry appliance 10, the laundry appliance 10 includes the access panel 46.

The access panel 46 is operable between the first condition 64, wherein the access panel 46 is attached to the front panel 42 of the cabinet 30, and the second condition 66, wherein the access panel 46 is detached from the front panel 42 of the cabinet 30. Further, the laundry appliance 10 includes the first lint filter 24, which is coupled to the access panel 46 and operable to move from the use position 68 to the maintenance position 70 with the access panel 46 as the access panel 46 moves from the first condition 64 to the second condition 66. The laundry appliance 10 also includes the second lint filter 26, which is coupled to the cabinet 30 and positioned downward of the first lint filter 24 in the use position 68 of the first lint filter 24. The second lint filter 26 is positioned within the airflow path 20 of the laundry appliance 10 and is configured to be accessible by the user while the access panel 46 is in the second condition 66, as illustrated in FIG. 5.

In operation of the first exemplary embodiment, a user loads laundry into the drum 12 of the laundry appliance 10 and turns on the laundry appliance 10 to dry the laundry. The blower 16 delivers process air 18 into the drum 12. The process air 18 flows out of the drum 12, through the first lint filter 24 toward the access panel 46, and through the second lint filter 26 away from the access panel 46 before being expelled from the airflow path 20 by the blower 16. As the process air 18 flows through the first and second lint filters 24, 26, particulate matter 28 (e.g., lint) is filtered from the process air 18 by the first and second lint filters 24, 26. Upon completion of the drying cycle of the laundry appliance 10, the user is able to remove the access panel 46 from the front panel 42 of the cabinet 30, such that the access panel 46 transitions from the first condition 64, wherein the access panel 46 is attached to the front panel 42, to the second condition 66, wherein the access panel 46 is detached from the front panel 42, as illustrated in FIG. 5. The first lint filter 24 is coupled to the access panel 46, such that the first lint filter 24 moves with the access panel 46 from the use position 68 to the maintenance position 70 as the access panel 46 is moved from the first condition 64 to the second condition 66. Having removed the access panel 46 from the front panel 42, the user next removes the particulate matter 28 from the exposed first and second lint filters 24, 26. Finally, the user returns the access panel 46 from the second condition 66 to the first condition 64, and thereby returns the first lint filter 24 from the maintenance position 70 to the use position 68.

In a second exemplary embodiment of the laundry appliance 10, the laundry appliance 10 includes the access panel 46, which is pivotably coupled to the front panel 42. The access panel 46 is operable to pivot from the first condition 64, wherein the first and second lint filters 24, 26 are covered by the access panel 46, to the second condition 66, wherein access is provided to the first and second lint filters 24, 26. Further, the first lint filter 24 is pivotably coupled to the front panel 42 of the cabinet 30 and operable to pivot relative to the front panel 42 of the cabinet 30 between the use position 68, as illustrated in FIG. 6, and the maintenance position 70, as illustrated in FIG. 7.

In operation of the second exemplary embodiment of the laundry appliance 10, a user loads laundry into the drum 12 of the laundry appliance 10 and turns on the laundry appliance 10 to dry the laundry. During the drying cycle, process air 18 is delivered by the blower 16 into the drum 12 to dry the laundry. The process air 18 flows out of the drum 12, through the first lint filter 24 toward the access panel 46, and through the second lint filter 26 away from the access panel 46. The divider 72 positioned between the first and second lint filters 24, 26 aids in keeping the process air 18 within the airflow path 20 by generally preventing the process air 18 from flowing around rather than through the second lint filter 26. Once the drying cycle is complete, the user pivots the access panel 46 from the first condition 64, as illustrated in FIG. 2, to the second condition 66, as illustrated in FIGS. 6 and 7, to reveal the first and second lint filters 24, 26. Next, the user pivots the first lint filter 24 about pivot axis 56 from the use position 68, as illustrated in FIG. 6, to the maintenance position 70, as illustrated in FIG. 7. The user then removes the particulate matter 28 from the first and second lint filters 24, 26 before pivoting the first lint filter 24 back to the use position 68 and pivoting the access panel 46 back from the first condition 64 to the second condition 66. Because the process air 18 flows through the second lint filter 26 while traveling away from the access panel 46, particulate matter 28 accumulates on a side of the second lint filter 26 that faces generally toward the access panel 46. As a result, the user is able to access and remove the particulate matter 28 from the second lint filter 26, when the access panel 46 is in the second condition 66, without adjusting the position of the second lint filter 26.

The laundry appliance 10 of the present disclosure provides a variety of advantages. First, the vertically offset opening 44, as illustrated in FIG. 9, can allow for larger first and/or second lint filters 24, 26 to be employed below the opening 44, which may increase the particulate matter 28 filtering capacity of the first and/or second lint filters 24, 26. Second, the first lint filter 24 including a first lint filter screen 50 that includes alternate ridges 52 and grooves 54, as exemplified in FIG. 8, can increase the surface area of the first lint filter screen 50, which can, in turn, increase the particulate matter 28 filtering capacity of the first lint filter 24. Third, the access panel 46 being operable to enter the second condition 66, wherein both the first and second lint filters 24, 26 are accessible by the user, can increase the convenience of accessing the first and second lint filters 24, 26 for the user.

According to one aspect of the present disclosure, a laundry appliance includes a cabinet having a front panel that defines an opening, a drum accessible via the opening and configured for processing laundry, an access panel pivotably coupled to the front panel and operable to pivot between first and second conditions, and a first lint filter pivotably coupled to the front panel and operable to pivot relative to the front panel between a use position and a maintenance position in the second condition of the access panel. The access panel covers the first lint filter in the first condition, and access to the first lint filter is provided in the second condition of the access panel.

According to another aspect, a second lint filter is positioned proximate to the first lint filter, wherein the access panel covers the second lint filter in the first condition, and access to the second lint filter is provided in the second condition of the access panel.

According to another aspect, a blower delivers process air through an airflow path that includes the drum, wherein the first and second lint filters are positioned within the airflow path to filter particulate matter from the process air, and the process air flows through the first lint filter toward the access panel and through the second lint filter away from the access panel.

According to another aspect, the second lint filter is positioned downward of the first lint filter.

According to another aspect, the first lint filter includes a first lint filter frame and a first lint filter screen that extends across the first lint filter frame, the second lint filter includes a second lint filter frame and a second lint filter screen that extends across the second lint filter frame, and the first lint filter screen and the second lint filter screen are generally coplanar in the use position of the first lint filter.

According to another aspect, the drum is configured to rotate about an axis of rotation, and a midpoint of the opening is disposed upward of the axis of rotation.

According to another aspect, the first lint filter includes a first lint filter frame and a first lint filter screen that extends across the first lint filter frame and is shaped to form alternate ridges and grooves.

According to yet another aspect, a laundry appliance includes a cabinet having a front panel. The laundry appliance also includes an access panel removably coupled to the front panel and operable between a first condition and a second condition. In the first condition, the access panel is attached to the front panel. In the second condition, the access panel is detached from the front panel. The laundry appliance also includes a first lint filter coupled to the access panel and operable between use and maintenance positions. The first lint filter is in the use position in the first condition of the access panel and the first lint filter is in the maintenance position in the second condition of the access panel. The laundry appliance further includes a second lint filter positioned proximate to the front panel. Movement of the access panel from the first condition to the second condition provides access to the second lint filter.

According to another aspect, a drum is positioned within the cabinet and operable to rotate about an axis of rotation, wherein, in the first condition of the access panel, at least one of the access panel and the front panel define an opening that provides access to the drum, and a midpoint of the opening is disposed upward of the axis of rotation.

According to another aspect, the opening is substantially circular.

According to another aspect, the first lint filter includes a first lint filter screen that is shaped to form alternate ridges and grooves.

According to another aspect, the second lint filter is downward of the first lint filter in the use position of the first lint filter.

According to another aspect, the second lint filter is configured to be removed from and returned to an operating position, and the second lint filter is configured to filter particulate matter from process air delivered by a blower in the operating position.

According to another aspect, a drum is positioned within the cabinet, and a blower delivers process air through an airflow path that includes the drum, wherein the first and second lint filters are positioned within the airflow path to filter particulate matter from the process air, and the process air flows from the drum to the first lint filter and subsequently to the second lint filter.

According to another aspect, the process air flows through the first lint filter toward the access panel and through the second lint filter away from the access panel.

According to yet another aspect, a laundry appliance includes a cabinet having a front panel that defines an opening, and a drum accessible via the opening and operable to rotate about an axis of rotation that is downward of a midpoint of the opening.

According to another aspect, the opening is substantially circular.

According to another aspect, an access panel is coupled to the front panel and operable between first and second conditions, and a first lint filter is proximate to the front panel and operable between a use position and a maintenance position in the second condition of the access panel, wherein the access panel covers the first lint filter in the first condition, and access to the first lint filter is provided in the second condition of the access panel.

According to another aspect, the access panel is pivotably coupled to the front panel and operable to pivot between the first and second conditions, and the first lint filter is pivotably coupled to the front panel and operable to pivot relative to the front panel between the use position and the maintenance position.

According to another aspect, the access panel is removably coupled to the front panel and operable between the first condition, wherein the access panel is attached to the front panel, and the second condition, wherein the access panel is detached from the front panel, and the first lint filter is coupled to the access panel and operable between the use and maintenance positions, wherein the first lint filter is in the use position in the first condition of the access panel and the first lint filter is in the maintenance position in the second condition of the access panel.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a cabinet having a front panel;

an access panel removably coupled to the front panel and operable between a first condition, wherein the access panel is attached to the front panel, and a second condition, wherein the access panel is detached from the front panel;

a first lint filter coupled to the access panel and operable between use and maintenance positions, wherein the first lint filter is in the use position in the first condition of the access panel and the first lint filter is in the maintenance position in the second condition of the access panel;

a second lint filter positioned proximate to the front panel, wherein movement of the access panel from the first condition to the second condition provides access to the second lint filter; and a drum positioned within the cabinet and operable to rotate about an axis of rotation, wherein, in the first condition of the access panel, at least one of the access panel and the front panel define an opening that provides access to the drum, and a midpoint of the opening is disposed upward of the axis of rotation.

2. The laundry appliance of claim 1, wherein the opening is substantially circular.

3. The laundry appliance of claim 1, wherein the first lint filter includes a first lint filter screen that is shaped to form alternate ridges and grooves.

4. The laundry appliance of claim 1, wherein the second lint filter is downward of the first lint filter in the use position of the first lint filter.

5. The laundry appliance of claim 1, wherein the second lint filter is configured to be removed from and returned to an operating position, and the second lint filter is configured to filter particulate matter from process air delivered by a blower in the operating position.

6. The laundry appliance of claim 1, further comprising:

a blower that delivers process air through an airflow path that includes the drum, wherein the first and second lint filters are positioned within the airflow path to filter particulate matter from the process air, and the process air flows from the drum to the first lint filter and subsequently to the second lint filter.

7. The laundry appliance of claim 6, wherein the process air flows through the first lint filter toward the access panel and through the second lint filter away from the access panel.

* * * * *